US005755126A

United States Patent [19]

Lanigan et al.

[11] Patent Number: 5,755,126

[45] Date of Patent: May 26, 1998

[54] SECURITY SYSTEM FOR CARGO LOADING DOORS

[76] Inventors: William P. Lanigan, 16946 Blue Heron Dr., Orland Park, Ill. 60462; Peter W. Mirabella, 7647 Starling Dr., Schereville, Ind. 46375; Gerald F. Chalko, Jr., 2306 Martha St., Unit 102, Highland, Ind. 46322

[21] Appl. No.: 934,087

[22] Filed: Sep. 19, 1997

Related U.S. Application Data

[63] Continuation of Ser. No. 532,300, Sep. 22, 1995, abandoned.

[51] Int. Cl.[6] ..... E05B 65/12

[52] U.S. Cl. ..... 70/257; 292/201; 70/278

[58] Field of Search ..... 70/257, 256, 278; 292/144, 96, 97, 201, 341.16, DIG. 49

[56] References Cited

U.S. PATENT DOCUMENTS

| | | | |
|---|---|---|---|
| 2,325,225 | 7/1943 | Burke | 292/DIG. 49 |
| 3,751,088 | 8/1973 | Schlage et al. | 292/201 |
| 3,805,693 | 4/1974 | Neitzel et al. | 292/201 |
| 3,813,119 | 5/1974 | Panici | 292/201 |
| 3,888,528 | 6/1975 | Jericijo | 292/DIG. 49 |
| 3,933,382 | 1/1976 | Counts et al. | 292/201 |
| 4,056,276 | 11/1977 | Jarvis | 292/DIG. 49 |
| 4,161,870 | 7/1979 | Barnes | 292/150 |
| 4,453,161 | 6/1984 | Lemelson | 340/825.31 |
| 4,573,333 | 3/1986 | Choi | 292/201 |
| 4,613,176 | 9/1986 | Kelly | 292/DIG. 49 |
| 4,848,809 | 7/1989 | Escaravage | 292/201 |
| 4,926,664 | 5/1990 | Gartner et al. | 70/278 |
| 5,058,939 | 10/1991 | Miilu | 292/DIG. 49 |
| 5,064,230 | 11/1991 | Ornduff, Sr. | 292/DIG. 49 |
| 5,076,625 | 12/1991 | Oxley | 292/201 |
| 5,250,849 | 10/1993 | Periou | 70/257 |
| 5,413,390 | 5/1995 | Filippi | 292/DIG. 49 |
| 5,490,697 | 2/1996 | Surko, Jr. | 292/DIG. 71 |
| 5,541,585 | 7/1996 | Duhame et al. | 340/825.31 |
| 5,686,894 | 11/1997 | Hosmer | 70/278 |

FOREIGN PATENT DOCUMENTS

| | | | |
|---|---|---|---|
| 2514306 | 4/1983 | France | 70/256 |
| 3927024 | 2/1990 | Germany | 70/256 |

*Primary Examiner*—Darnell M. Boucher

[57] ABSTRACT

A retrofitable or factory installable security system (50) for cargo loading doors is disclosed. The system (50) has: a remote transmitter (52) for transmitting a radio signal; a receiver (54) for receiving the radio signal from the remote transmitter (52); an electro-mechanical actuator (56) coupled to the receiver (54) for moving a latching device (66) between a locked position and an unlocked position; and the lock assembly (58) has a housing (64) for holding the electro-mechanical actuator (56), the latching device (66) is pivotably connected to the housing (64), and a linkage mechanism (68) coupling the electro-mechanical actuator (56) and the latching device (66). The latching device (66) can be moved between the locked and unlocked positions.

13 Claims, 5 Drawing Sheets

52
126
10
128
38
24
54
50
124
18
16
12
14
32
32
18
20
22
18
34
34
16
36
36
28
26
16
18
30
40
30

SECURITY SYSTEM FOR CARGO LOADING DOORS

This application is a continuation of U.S. Ser. No. 08/532,300 filed Sep. 22, 1995, now abandoned.

FIELD OF THE INVENTION

This invention relates to security systems, and particularly to retrofitable and factory installable security systems for cargo loading doors and enclosures.

BACKGROUND OF THE INVENTION

FIG. 1 shows the back of a conventional semi-trailer or cargo container 10 or other similar enclosed body, preferably in the form of an International Standards Organization (ISO) container, domestic container or semi-trailer, having a pair of doors 12 and 14, hinged along their outer edges at 16 and 18 to opposite vertical sides 20 and 22 of door frame or opening 24. Thus, doors 12 and 14 are mounted for relative rotation in opposite directions around sides 20 and 22 between a closed position as shown in FIG. 1, and an open position. When either or both doors 12 and 14 are open, ready access is provided through door opening 24 to load or unload cargo into or out of the trailer or container 10.

When doors 12 and 14 are closed, an overlapping tab (door retainer) which can be internal or external to the doors, can be used. In use, door 12 is closed first and thereafter door 14 is closed to overlap and hold door 12 closed. Typically, an overlapping tab (door retainer) which is external to the doors can be used to overlap door 12. Subsequently, door 14 is typically opened first before door 12 can be rotated to the open position.

Carried by each door is a conventional closure assembly of any number of axially rotatable rods 30, suitably journaled in upper and lower brackets 32 and 34 on the door and provided with a handle 36. The upper and lower ends of the rod 30 engage with cam members 38 and 40 and bring the door to a fully closed position as the handle 36 and attached rod 30 are manually rotated to the position in FIG. 1. When in this position, a padlock or the like can be used to keep handle 36 and attached rod 30 in the closed position, as shown.

Accordingly, the manually operable closure means (rod 30, brackets 32 and 34, handles 36 and cam members 38 and 40) are located on the exterior of the container 10 where they are readily accessible by authorized and unauthorized workers and drivers, as well as would be thieves intent on stealing products and goods which may be contained in the semi-trailers and similar bodies and like enclosures. Previously, the security for these trailers, ISO containers, domestic containers and the like has been quite poor, usually consisting of a padlock and/or seal having an exposed link which can be cut by bolt cutters or equivalent tools. Thus, semi-trailers, containers and trucks left unattended for any length of time, as over night in truck terminals, intermodal terminals and freight yards, on shipping docks and piggy-back railroad cars, or at industrial or commercial loading areas (and during transit), are vulnerable to thievery and pilferage.

The problem of vulnerability of externally located closure means is minimized by the present invention, through the employment of a retrofitable or factory installed security system adapted to be located within a container, where it is not accessible to a would be thief or opportunist.

There is an ever demanding requirement for improved security systems for cargo loading doors and enclosures for the worldwide transportation industry.

DETAILED DESCRIPTION OF THE PREFERRED EMBODIMENT

Referring to the figures, a retrofitable or factory installable security system 50 is shown. The security system 50 is particularly adapted for cargo loading doors for cargo containers, ISO containers, domestic containers, truck trailers and the like (hereafter referred to as "containers"). Placement of system 50 may vary from the position (top right) shown in FIG. 1 and the other figures, the placement shown in the figures being a preferred placement to minimize the possibility of breakage during loading and unloading of cargo.

Figure 5:
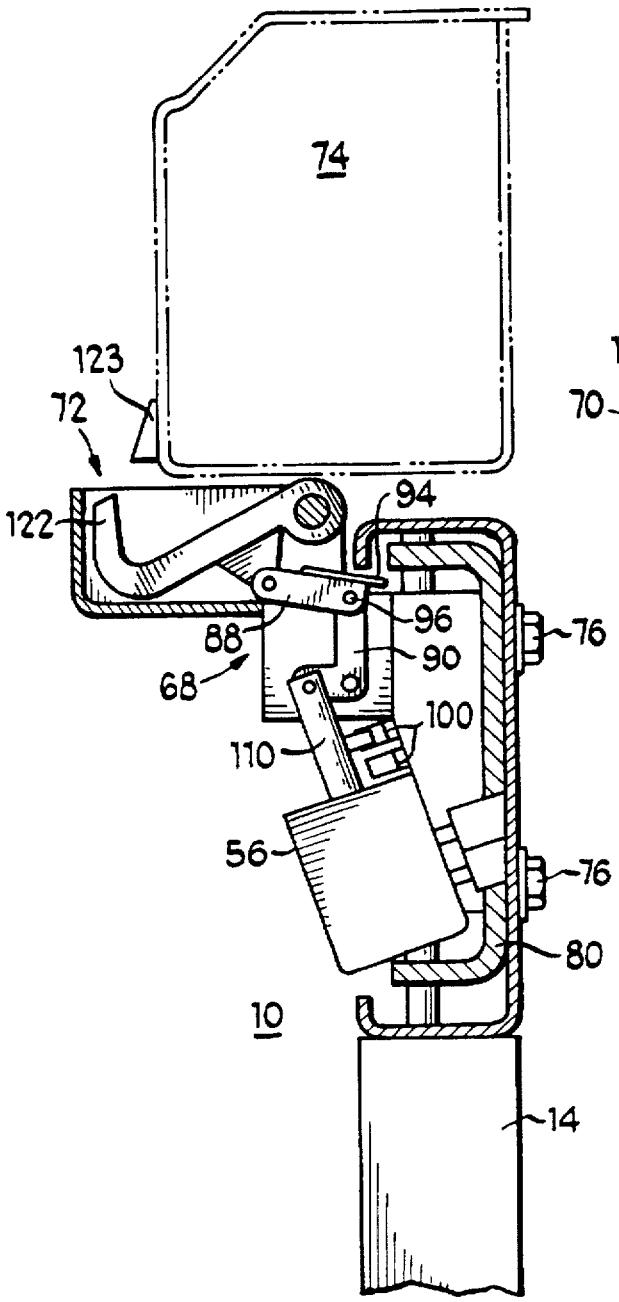
FIG. 5 is a cut away view taken along the lines 5—5 in FIG. 2, of a portion of the security system showing the latching device in a relaxed position (or a portion of a lock assembly in an unlocked position), in accordance with the present invention.
Figure 6:
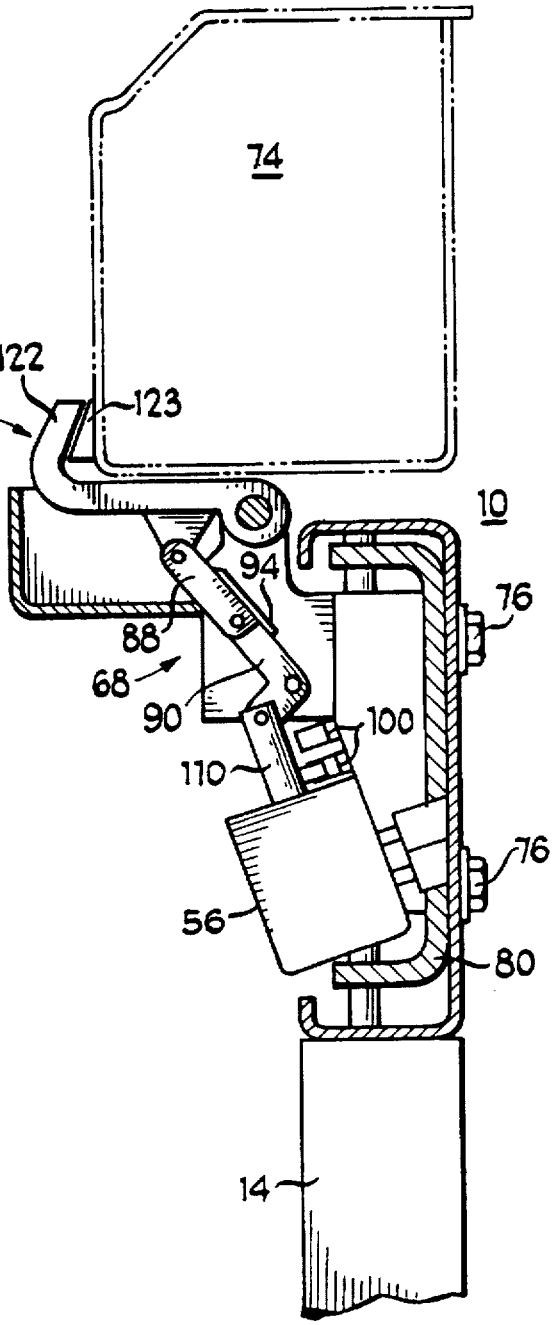
FIG. 6 is a cut away view taken along the lines 5—5 in FIG. 2, of a portion of the security system showing the latching device in a raised position (or a portion of the lock assembly in a locked position), in accordance with the present invention.
Figure 8:
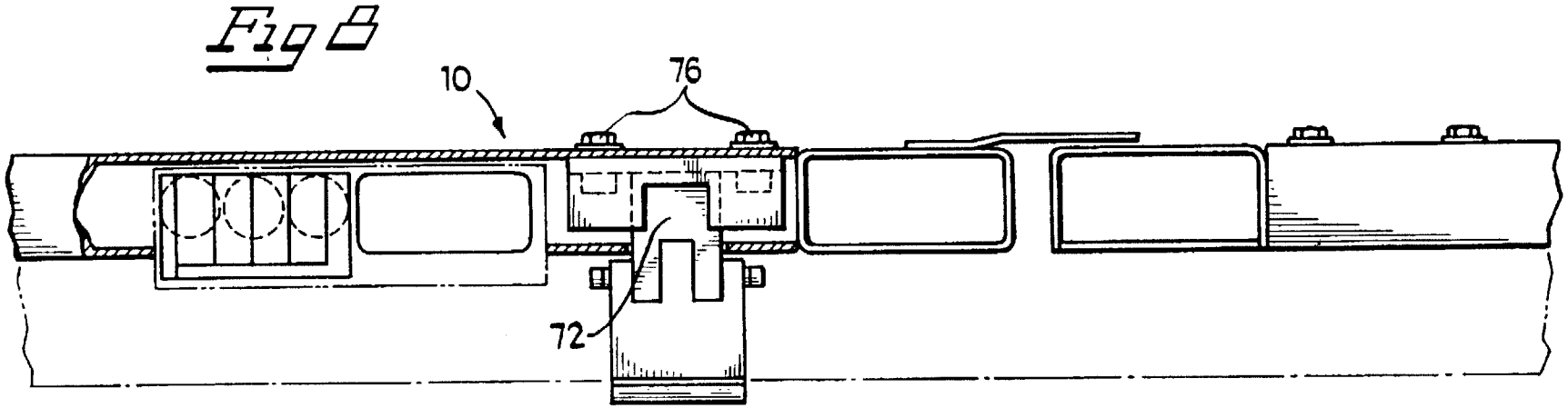
FIG. 8 is a top view of a portion of the security system in FIGS. 1–7, in accordance with the present invention.

The security system 50 in its simplest form, comprises: a remote transmitter 52 for transmitting a radio signal; a receiver 54 for receiving the radio signal from the remote transmitter 52; an electro-mechanical actuator 56 coupled to the receiver 54 for moving a latching device 66 between a locked position 60 and an unlocked position 62; and a lock assembly 58 including a housing 64 for holding the electro-mechanical actuator 56, a latching device 66 pivotably connected to the housing 64, and a linkage mechanism 68 coupling the electro-mechanical actuator 56 and the latching device 66 for moving the latching device 66 to and from a raised position 70 to a relaxed position 72, whereby the latching device 66 is movable between the locked position 60, as shown in FIG. 6, and unlocked position 62, in FIG. 5, respectively.

In one embodiment, the remote transmitter and receiver can each be transceivers, for an improved intelligent communication system. The system can provide, but is not limited to, for storage, identification, memory and interrogation of the system 50. For example, this feature could provide a history of all door openings, closings and tamperings of the system 50.

This system is configured to be tamper resistant because of it's placement which is preferably internal to a container. In addition, system 50 has been designed in a preferred embodiment to have a low profile to minimize intrusion into the valuable cargo space of the container. In one embodiment, only one latching mechanism is necessary to lock two doors when utilized with a door retainer or the like, providing simplicity of design. As should be understood, other embodiments can include a plurality of latching mechanisms.

Figure 1:
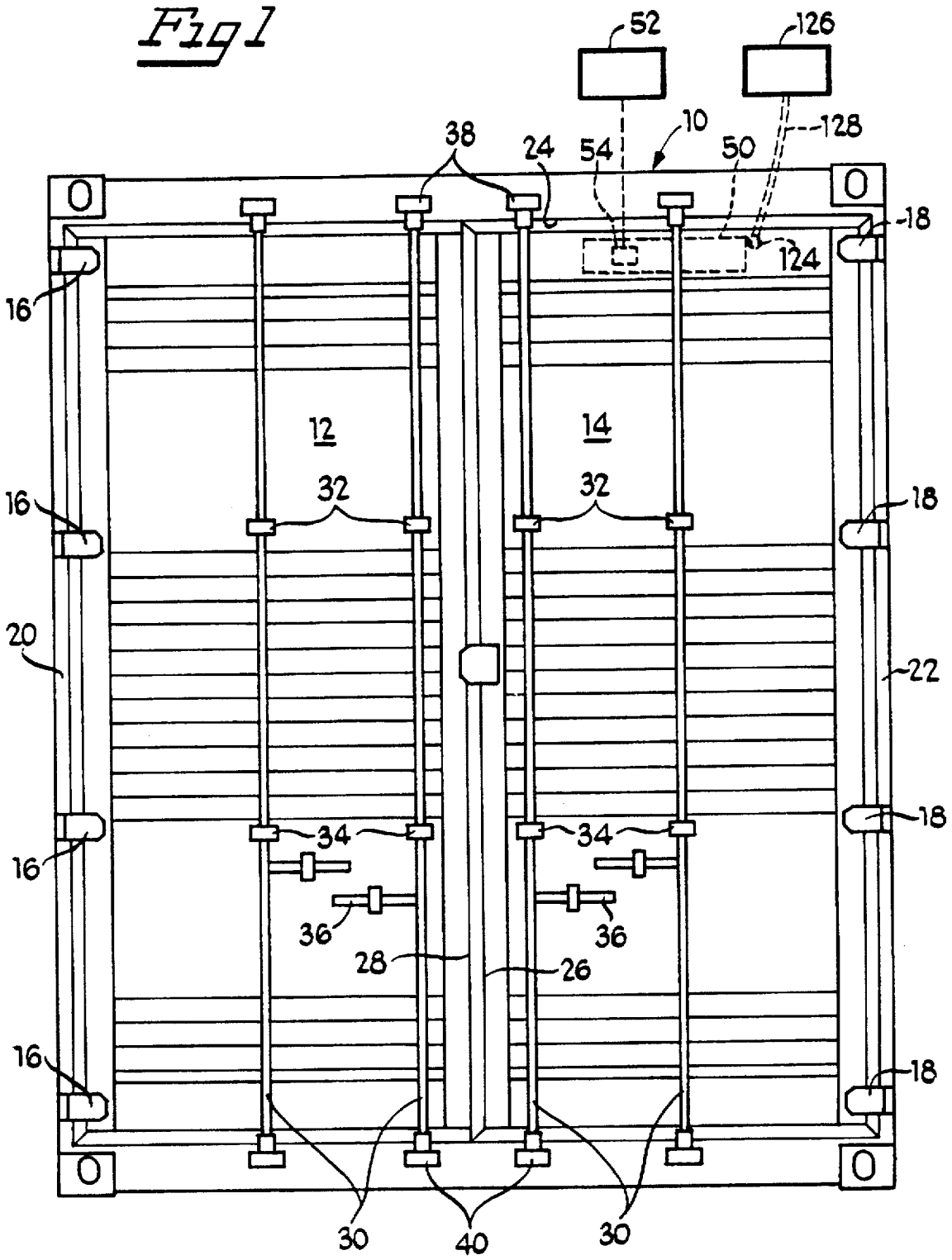
FIG. 1 is a rear view of an ISO container or other similar enclosed body, showing in dashed line a typical placement of part of a security system for cargo loading doors, in accordance with the present invention.

In a preferred embodiment, the housing 64 is adapted to be connected to an inside of a cargo loading door, such as positioned at the top right corner, as shown in dashed line as item 50 in FIG. 1. This remote placement is out of the way so as not to interfere with the loading and unloading operation. Thus, this strategic position provides a substantially tamper proof security system, preferably with internal placement of system 50, so as to be visually hidden from an opportunist or thief.

Also in a preferred embodiment, the latching device 66 is particularly adapted to latch to a header 74 of an ISO container 10 when the latching device 66 is in the locked position 60 and unlatched from the header 74 when the latching device 66 is moved to the unlocked position 62, as shown in FIGS. 5 and 6. By utilizing a header of a container to lock the doors, a retrofittable or factory installable system 50 is easily installed, thus minimizing the need for cutting, drilling or welding during installation.

Figure 4:
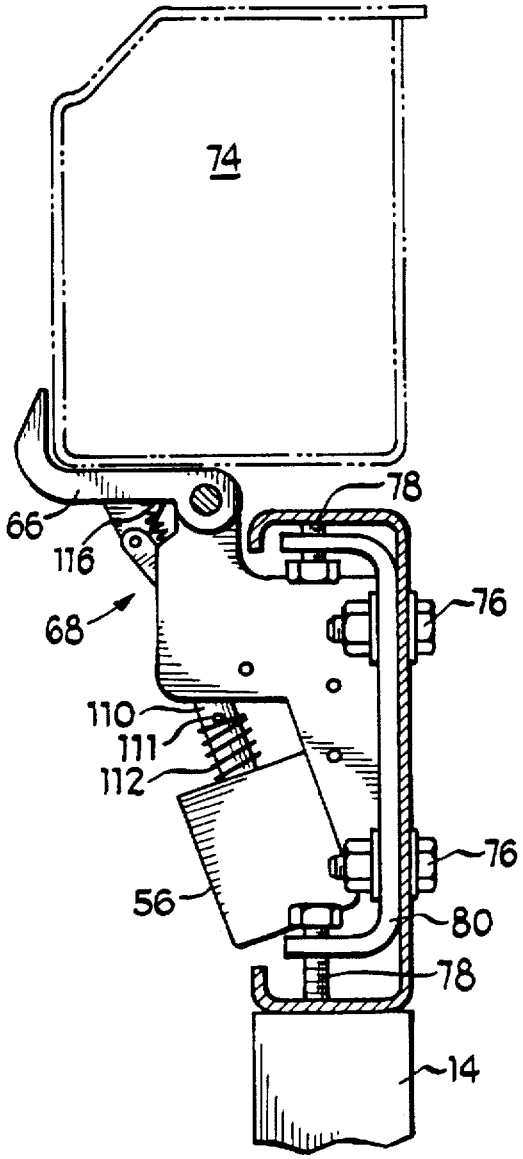
FIG. 4 is a side view taken along the lines 4—4 in FIG. 2 without a cover, of a portion of the security system, in accordance with the present invention.

In one embodiment as shown in FIG. 4, the housing 64 can include primary connecting devices 76, or fastening means such as bolts and nuts extending through the door and attach a portion of the system 50 to the inside door 14. Also, secondary connecting devices or supplemental fastening means such as set screws or bolts applying outward axial pressure can be used, to define a secondary securement mechanism between the housing 64 and the cargo loading door 14. The primary connecting devices 76 provide accuracy and consistency in placement, location and alignment of a portion of the system 50. Further, the secondary connecting devices 78, in the event of removal of the primary devices 76 (during a break in), continue to secure and maintain the system 50 at the desired position.

Figure 9:
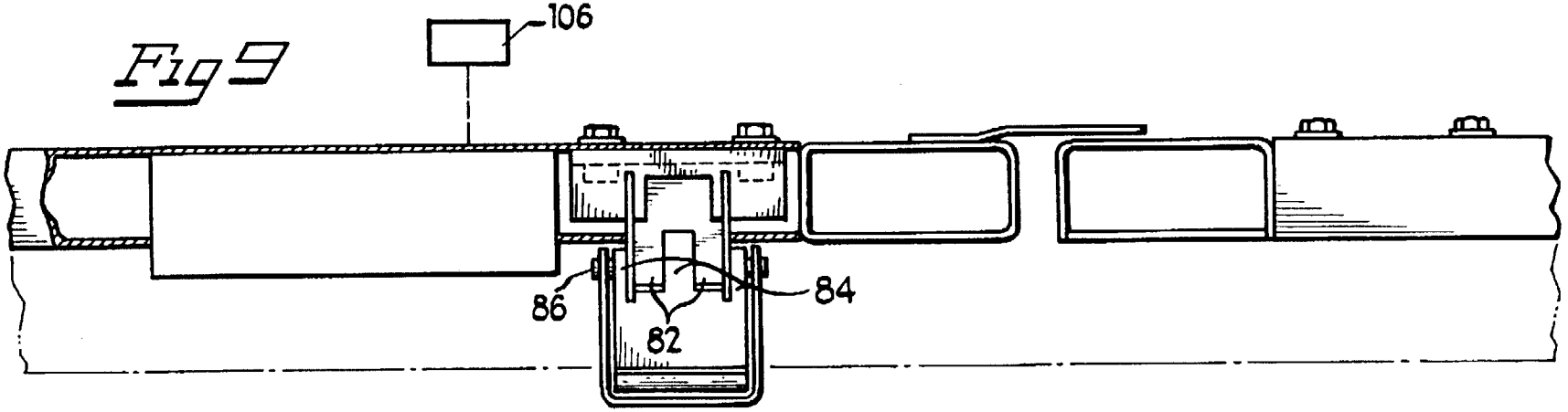
FIG. 9 is a top view of a portion of the security system in FIGS. 1–7 with an optional external antenna, in accordance with the present invention.

As best shown in FIG. 9, the housing 64 can further include a back plate 80 with a plurality of outwardly extending anchor members 82, which are adapted to be coupled with a plurality of hinge members 84 of the latching device 66, via a pivot pin 86. Advantageously, this structure allows the lock assembly 58 to easily move from the locked position 60 to the unlocked position 62. This structure also allows for variations in door and frame geometries.

As illustrated in FIGS. 5 and 6, the linkage mechanism 68 includes an elongated distal section 88 and an L-shaped proximal section 90, the distal section 88 is coupled to the latching device 66 and a short leg 92 of the L-shaped proximal section 90 is couplable with the electro-mechanical actuator 56. This structure provides the advantages of converting minimal linear motion to angular motion required to move the latching device 66 from the locked to the unlocked position and vice versa. Advantageously, it also simulates a rigid link thus holding the latch 66 in its locked position and diverting any forces from the electro-mechanical actuator 56 to the housing 64, for improved strength and Integrity. Additionally, in this position the system 50 is self locking and requires essentially no battery power, thus minimizing battery drain.

In one embodiment, the elongated distal section 88 includes a stop tab 94. The stop tab 94 properly aligns the linkage mechanism 68 beyond center with respect to the proximal section 90 to simulate a rigid link securing the latching device 66 in its locked position 60, in FIG. 6.

The L-shaped proximal section 90 and the elongated distal section 88 are couplable with a pivot pin 96. The pivot pin 96 allows rotation and transfer of motion through the distal section 88 to the latching device 66.

As shown in the figures, the L-shaped proximal section 90 is pivotably connected to the anchor members 82 of the housing via a stationary pivot pin 98. The pivot pin 98 is significant in the conversion of linear to angular motion, and maintaining a simulated rigid link. It is connected to a middle portion of the anchor members 82 of the housing 64. This allows a minimal amount of displacement from the electro-mechanical actuator 56 to move and rotate the latching device 66.

As best shown in FIGS. 5 and 6, the electro-mechanical actuator 56 can include one or more sensors 100 for sensing whether the lock assembly 58 is in the locked or unlocked position 60 or 62. In the event that the latching device 66 is not in a position after a given command, from the remote transmitter 52, the sensor(s) 100 can provide a signal that will allow re-execution automatically after a predetermined time, for example. In addition, this structure can provide feedback in order to give positioning data as to internal location of the latching device 66.

In one embodiment, the security system 50 includes an electronic control 102 or interface structure, coupled to the receiver 54 and the electro-mechanical actuator 56. This structure interprets the transmitted information to suitably execute an open or close command, for example. Advantageously, this structure can receive information from the remote transmitter 52 without the necessity of an external power source other than the batteries or power supplies 108 shown in the figures. Also, this structure 102, like most of the other components of the security system 50, has a narrow width or profile so as to minimally intrude into the valuable cargo space.

Figure 2:
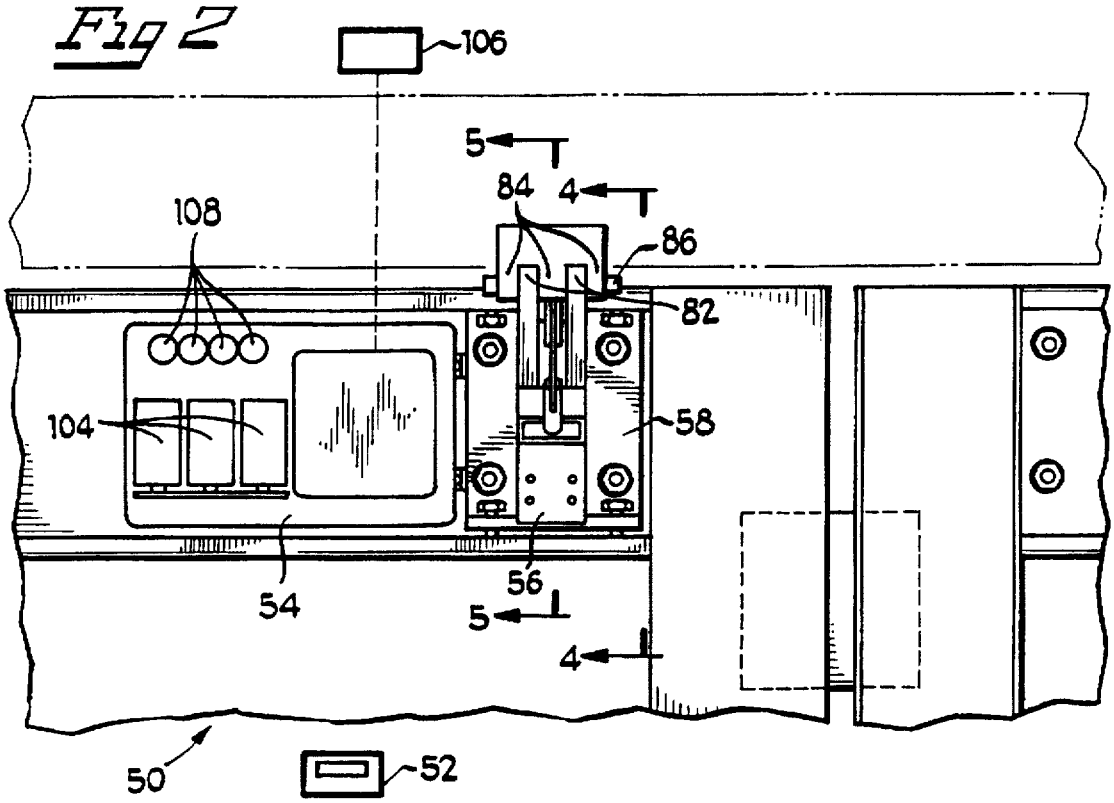
FIG. 2 is an inside view of part of the security system, without a cover (to show the placement of some of the various components) and a remote transmitter, in accordance with the present invention.
Figure 3:
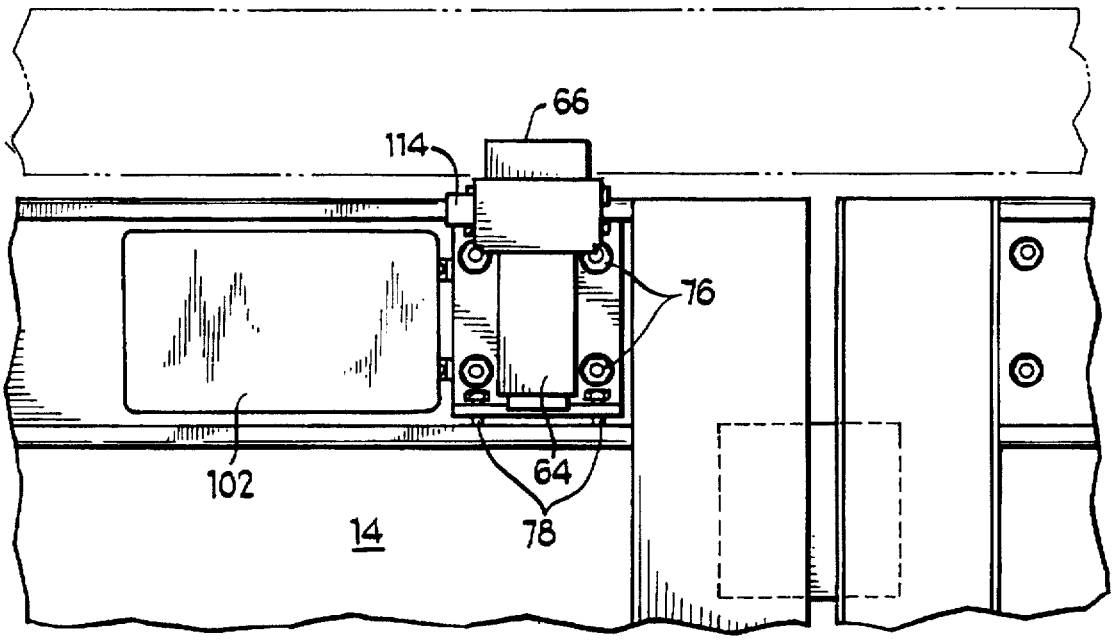
FIG. 3 is an inside view of part of the security system, with a cover which protects many of the components, in accordance with the present invention.

As shown in FIG. 2, the security system 50 includes an electronic control or interface structure 102 coupled to the receiver 54 and the electro-mechanical actuator 56, capacitor(s) 104, an antenna 106 and power supplies 108. The capacitors 104 suitably build-up and store energy to rapidly release an electrical charge, to actuate the electro-mechanical actuator 56, to appropriately move a plunger 110. This provides an efficient use of the energy supplied by the power supply 108, preferably in the form of batteries. The antenna can vary widely depending on the application, and can be of a conventional type or patch type, for example. In a preferred embodiment, the antenna is placed internal to a container to keep it hidden and minimize the possibility of damage, and is operably coupled to the system 50, for suitable reception of a signal. In another embodiment, the antenna could be external, if desired.

In a preferred embodiment, a sensor, such as but not limited to, a proximity sensor 114 can be utilized to allow the latch to be actuated only when a door 14 is in proximity to a metallic material, such as a header 74. Thus, this feature can help to minimize damage to the latching device 66, when closing the door with the latching device 66 in a locked position. The sensor 114 is suitably connected to the other components of the security system 50, for example 54, 56, and 64 and is preferably physically connected to and in proximity of the latch 66, for accurate sensing.

In FIG. 4, the electro-mechanical actuator 56 includes a plunger 110, a snap ring 111 and a spring 112. The spring provides an outward force to bias the plunger 110 to an extended position when the plunger 110 is released.

A second spring 116 is shown in FIG. 4, and can be used to help push (bias) the latch 66 to the locked position if desired. The spring can help to contribute to minimizing current drain and facilitating movement to the locked position. It is strategically and physically located between the latching device 66 and anchor member 82 of the housing 64 so as not to require more space, thus providing minimal space requirements for the system 50.

Figure 7:
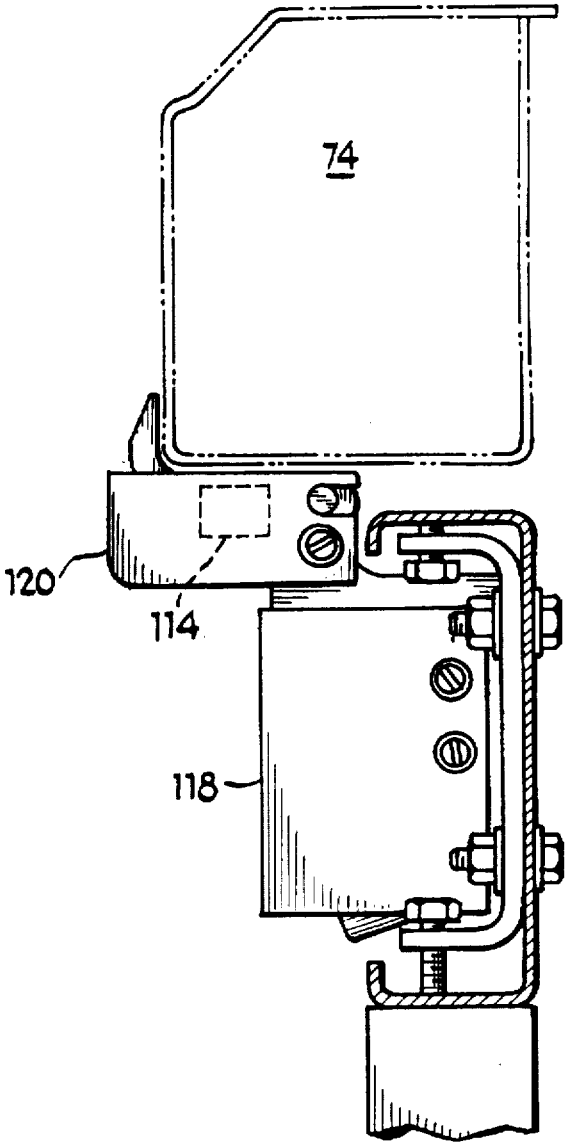
FIG. 7 is a side view taken along the lines 4—4 in FIG. 2 with a solenoid cover and latch guard for a portion of the security system, in accordance with the present invention.

As best shown in FIG. 7, the housing 64 can include a solenoid cover 118 and latch guard120 for protecting the latching device (and linkage) from load shifts.

In use, the electro-mechanical actuator 56 is in a form of a solenoid, and can be suitably actuated, to convert electrical energy to a mechanical energy. Thus, this structure can generate a pulling action to provide the locked position 60 in FIG. 6. Continuing, the plunger 110 continues until it bottoms out internally against a permanent magnet within the actuator 56, thus, positioning the linkage to provide a simulated rigid link. Subsequently, when the actuator 56 is next actuated via the remote transmitter 52, the solenoid by use of the windings, releases the plunger 110 to allow it to move away from the magnet (to move to an extended, solenoid plunger 110 position) extending outwardly, defining an unlocked position as shown in FIG. 5.

As shown in FIGS. 5 and 6, the latching device includes an L-shaped latch 122 with a predetermined angle adapted to be coupled with a complementarily configured block 123 connected to a header 74 of a container, to provide a self-engaging connection.

In one embodiment, a port 124 is included in the door 12, to provide access to a electronic key126 having an external probe means 128, for connection to system 50, to provide one or more of: external power to the system 50; a battery charger; open and close signals to the system 50; interrogate the system 50 and the like.

Although various embodiments of the invention have been shown and described, it should be understood that various modifications and substitutions, as well as rearrangements and combinations of the preceding embodiments, can be made by those skilled in the art.

What is claimed is:

1. A security system for cargo loading doors, comprising:

a remote transmitter for transmitting a radio signal; and a substantially portable and independently powered receiver for receiving the radio signal from the remote transmitter, comprising:

an electro-mechanical actuator comprising a solenoid coupled to the receiver which moves a latching device between a locked position and an unlocked position; and a lock assembly including a substantially rectangular housing which contains the electro-mechanical actuator and is adapted for connection to an interior surface of a loading door, the latching device is moveably connected to the housing, and a linkage mechanism coupling the electro-mechanical actuator and the latching device, said linkage mechanism moves the latching device to and from the locked position and the unlocked position and is adapted to latch to a header of a container when the latching device is in the locked position and to unlatch from the header when the latching device is in the unlocked position to allow opening of the loading door, the linkage mechanism defining a simulated rigid link when the latching device is in the locked position and the linkage mechanism includes an elongated distal section and an L-shaped proximal section, the distal section coupled to the latching device and a short leg of the L-shaped proximal section is couplable with the electro-mechanical actuator, the elongated distal section and the L-shaped proximal section pivoting substantially upwardly and inwardly toward the narrow profile housing when the solenoid is in an extended condition defining the unlocked position and providing the simulated rigid link wherein the elongated distal section and a long leg of the L-shaped proximal section are substantially aligned when the solenoid is in a retracted condition defining the locked position, and the linkage mechanism includes a stop tab to substantially align the elongated distal section and the long leg of the L-shaped proximal section beyond center to define the simulated rigid link.

2. The security system of claim 1, wherein the latching device is adapted to latch to a header of an ISO container, domestic container or semi-trailer, when the latching device is in the locked position and unlatched from the header when the latching device is in the unlocked position.

3. The security system of claim 1, wherein the latching device is mounted at a predetermined angle and is adapted to be coupled with a complementarily configured block connected to a header of a container, to provide a self-engaging connection.

4. The security system of claim 1, wherein the L-shaped proximal section is pivotably connected to anchor members of the housing via a stationary pivot pin.

5. The security system of claim 1, further comprising at least one electronic sensor for sensing whether the latching device is in the locked or unlocked position, whereby predetermined feedback signal provides positioning data as to the internal location of the latching device.

6. The security system of claim 1, wherein the latching device includes:

an electronic control, operatively coupled to the receiver and the electro-mechanical actuator, including a trigger circuit, capacitors and power semiconductors to actuate the latching device; and at least one of the transmitter and receiver includes a transceiver.

7. The security system of claim 1, wherein the latching device includes an electronic control operatively coupled to the receiver and the electro-mechanical actuator, an antenna and a power supply.

8. The security system of claim 1, wherein the latching device includes an electronic control operatively coupled to the receiver and the electro-mechanical actuator, having at least one capacitor having a predetermined capacitance.

9. The security system of claim 1, wherein the housing has an input for at least one of receiving an electric charge and electronic key and includes at least one of a solenoid cover and a latch guard.

10. The security system of claim 1, wherein the elongated distal section includes a stop tab substantially aligning the linkage mechanism with respect to the proximal section, to provide the simulated rigid link securing the latch device in the locked position.

11. The security system of claim 1, wherein the locking assembly includes an electronic control operatively coupled to the receiver and the electro-mechanical actuator, the electronic control includes a sensor which allows the electro-mechanical actuator to be actuated only when it provides a predetermined feedback signal.

12. A security system for cargo loading doors, comprising:

at least one of a remote transmitter and electronic key for transmitting a signal; and a substantially portable and independently powered receiver for receiving the signal from at least one of the remote transmitter and the electronic key, comprising:

an electro-mechanical actuator comprising a solenoid coupled to the receiver which moves a latching device between a locked position and an unlocked position; and the latching device attached to a substantially rectangular housing connectable on an interior surface of a cargo loading door for holding the electro-mechanical actuator; said latching device being pivotably connected to the housing, and having a linkage mechanism coupling the electro-mechanical actuator and the latching device for moving the latching device to and from the locked position and the unlocked position, the linkage mechanism defining a simulated rigid link when the latching device is in the locked position and the linkage mechanism includes an elongated distal section and an L-shaped proximal section, the distal section is coupled to the latching device and a short leg of the L-shaped proximal section is couplable with the electro-mechanical actuator, the elongated distal section and the L-shaped proximal section pivoting substantially upwardly and inwardly toward the narrow profile housing when the solenoid is in an extended condition defining the unlocked position and providing the simulated rigid link wherein the elongated distal section and a long leg of the L-shaped proximal section are substantially aligned when the solenoid is in a retracted condition defining the locked position, and the linkage mechanism includes a stop tab to substantially align the elongated distal section and the long leg of the L-shaped proximal section to define the simulated rigid link.

13. The security system of claim 12, wherein the latching device includes an electronic control operatively coupled to the receiver and the electro-mechanical actuator, the electronic control includes a sensor which allows the electro-mechanical actuator to be actuated only when it provides a predetermined feedback signal.

* * * * *